US011364596B2

(12) United States Patent
Lee

(10) Patent No.: US 11,364,596 B2
(45) Date of Patent: Jun. 21, 2022

(54) LOCKING PLIERS

(71) Applicants: BRAINSANGSANG CO., LTD., Jeollanam-do (KR); SIGHTGLASS CO., LTD., Gangwon-do (KR)

(72) Inventor: Jong Ha Lee, Jeollanam-do (KR)

(73) Assignees: BRAINSANGSANG CO., LTD., Jeollanam-do (KR); SIGHTGLASS CO., LTD., Gangwon-do (KR)

( * ) Notice: Subject to any disclaimer, the term of this patent is extended or adjusted under 35 U.S.C. 154(b) by 0 days.

(21) Appl. No.: 17/422,013

(22) PCT Filed: May 28, 2020

(86) PCT No.: PCT/KR2020/006883
§ 371 (c)(1),
(2) Date: Jul. 9, 2021

(87) PCT Pub. No.: WO2021/010590
PCT Pub. Date: Jan. 21, 2021

(65) Prior Publication Data

US 2022/0040823 A1 Feb. 10, 2022

(30) Foreign Application Priority Data

Jul. 17, 2019 (KR) ..... 10-2019-0086425

(51) Int. Cl.
*B25B 7/12* (2006.01)

(52) U.S. Cl.
CPC ..... *B25B 7/123* (2013.01)

(58) Field of Classification Search
CPC ..... B25B 7/123; B44D 3/185
USPC ..... 81/368–371
See application file for complete search history.

(56) References Cited

U.S. PATENT DOCUMENTS 3,306,143 A * 2/1967 Ortman ..... B25B 7/123 81/368
3,635,107 A * 1/1972 Schmidt ..... B25B 7/02 81/367
4,181,046 A * 1/1980 Lamb ..... B25B 7/00 140/123.5
5,568,698 A * 10/1996 Harding ..... A01K 97/00 362/119
6,178,855 B1 1/2001 Bally et al.
6,260,277 B1 * 7/2001 Wu ..... A01G 3/02 30/232
8,024,998 B1 9/2011 Valencia
(Continued)

FOREIGN PATENT DOCUMENTS

KR 10-1999-0073572 A 10/1999
KR 10-0713559 B1 5/2007
(Continued)

OTHER PUBLICATIONS

International Search Report for PCT/KR2020/006883 dated Sep. 25, 2020.

*Primary Examiner* — Hadi Shakeri
(74) *Attorney, Agent, or Firm* — The PL Law Group, PLLC

(57) ABSTRACT

Locking pliers according to an embodiment of the present disclosure can be easily unlocked by pressing a pressing unit of an opening lever with a thumb while gripping the levers with one hand, and the locking pliers can give tension to an object by pulling the object through the principle of leverage.

3 Claims, 4 Drawing Sheets

(56) References Cited

U.S. PATENT DOCUMENTS

| | | | | |
|---|---|---|---|---|
| 8,225,700 | B2 * | 7/2012 | Hile | B25B 7/123 81/368 |
| 2017/0087694 | A1 | 3/2017 | Deane | |

FOREIGN PATENT DOCUMENTS

| | | | |
|---|---|---|---|
| KR | 10-0729179 | B1 | 6/2007 |
| KR | 10-2008-0025510 | A | 3/2008 |
| KR | 20-2014-0000466 | U | 1/2014 |
| KR | 10-2102989 | B1 | 4/2020 |

* cited by examiner

LOCKING PLIERS

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2020/006883, filed May 28, 2020, which claims priority to the benefit of Korean Patent Application No. 10-2019-0086425 filed in the Korean Intellectual Property Office on Jul. 17, 2019, the entire contents of which are incorporated herein by reference.

BACKGROUND

1. Technical Field

The present disclosure relates to locking pliers and, more particularly, to locking pliers having a structure by which the locked position of the locking pliers may be simply released by pressing a pressing portion of an opening lever with the thumb of one hand while levers of the locking pliers are being held with one hand, and an object may be drawn and tensioned according to the lever principle.

2. Background Art

Locking pliers are tools configured to be locked into position while holding an object.

Locking pliers were invented by IRWIN Company in the USA in 1924 and commercially distributed with a tradename Vise-Grip. At present, Vise-Grip is being widely sold by IRWIN Company.

FIG. 1 is a view illustrating the unfastened position (i.e., unlocked position) of typical locking pliers, and FIG. 2 is a view illustrating the fastened position (i.e., the locked position) of typical locking pliers.

Referring to FIGS. 1 and 2, typical locking pliers 10 include a fixing lever 11, a pivot jaw 12 hinged to the fixed lever 11 such that a distal end of the pivot jaw 12 may pivot toward a distal end of the fixed lever to hold an object, a movable lever 13 hinged to the pivot jaw 12 to pivot the pivot jaw 12 when pressed, and an adjustment bar 14 with one end thereof being hinged to the movable lever 13 and the other end thereof being hinged to an adjustment bolt 15 provided on the fixed lever 11. When the movable lever 13 is pressed, the adjustment bar 14 fixes the pressed position.

In addition, when an unlocking lever 16 is pressed in the fastened position as illustrated in FIG. 2, the unlocking lever 16 presses the adjustment bar 14 to move the movable lever 13 away from the fixed lever 11 so that the distance between the movable lever 13 and the fixed lever 11 is widened, so that the fastened position is released.

Furthermore, the locking pliers 10 use a toggle mechanism having a structure comprised of four links A, B, C, and D. When in the unfastened position as in FIG. 1, the angle θ1 between the link A and the link B is about 90°. When the locking pliers are pressed so that the angle θ2 the link A and the link B is equal to or less than 180°, the fastening is accomplished.

In addition, in the typical locking pliers 10, it is impossible to accomplish unfastening with one hand holding the locking pliers 10 since the unlocking lever 16 is hinged to the inner portion of the movable lever 13. The unlocking lever 16 must be pressed with the other hand to accomplish the unfastening. Thus, it is difficult to use locking pliers in some operations, such as an operation of drawing canvas and fixing the canvas to a signboard frame, in which fastening and unfastening must be performed rapidly.

SUMMARY

Accordingly, the present disclosure has been made keeping in mind the above problems occurring in the prior art, and an objective of the present disclosure is to provide locking pliers having a structure by which locking and unlocking operations may be performed rapidly in a simple manner with one hand by pressing an opening lever with the thumb of one hand holding levers of the locking pliers.

Another objective of the present disclosure is to provide locking pliers having a structure by which an object may be drawn and tensioned according to the lever principle.

In order to accomplish the above objective, the present disclosure provides locking pliers including a fixed lever, a pivot jaw hinged to the fixed lever such that a distal end of the pivot jaw pivots toward a distal end of the fixed lever to hold an object, a movable lever hinged to the pivot jaw to pivot the pivot jaw when pressed, and an adjustment bar having one end thereof being hinged to the movable lever and the other end thereof being hinged to an adjustment bolt provided on the fixed lever, wherein, when the movable lever is pressed, the adjustment bar fixes the movable lever in a pressed position. The locking pliers may further include a bar-shaped opening lever hinged to the adjustment bar instead of the movable lever so as to be pivotable, the opening lever comprising a front portion and a rear portion on both sides of a hinge shaft, the front portion facing the pivot jaw. In operating the locking pliers, a bottom of the fixed lever may be to be covered with four fingers except for the thumb and the thumb may be to be placed on top of the movable lever to use the locking pliers in a position in which the fixed lever is located below while the movable lever is located above. A pressing portion may be provided on the front portion. The pressing portion may be configured to be pressed with the thumb of a hand holding the fixed lever and the movable lever. The rear portion may be in contact with the movable lever when a locked position is accomplished when the movable lever is pressed and push the movable lever upward from a side of the fixing lever to release the locked position when the pressing portion is pressed in a direction from the movable lever to the fixed lever.

In an exemplary embodiment, an unlocking lever may be provided on and hinged to the movable lever, the unlocking lever being configured such that one end thereof is in contact with the adjustment bar when in the locked position and presses the adjustment bar when the other end thereof is pressed so that the movable lever is moved away from the adjustment bar to release the locked position. The rear portion of the opening lever may be in contact with one end of the unlocking lever when in the locked position and moves one end of the unlocking lever away from the adjustment bar to release the locked position when the pressing portion is pressed.

In an exemplary embodiment, engagement pads may be provided on a distal end of the fixed lever and a distal end of the pivot jaw, the engagement pads having predetermined areas and being configured to hold an object. The fixed pad may include a lever pad configured to be supported and rotated on a bottom of a fixed structure to draw the object according to lever principle while the object is being held by the engagement pads.

As described above, the present disclosure has the following excellent effects.

First, in the locking pliers according to the present disclosure, there are advantages in that the fastening may be accomplished by holding both the fixed lever and the movable lever with one hand and the unfastening may be accomplished rapidly and simply by pressing the opening lever with the thumb of one hand holding the fixed lever and the movable lever.

In addition, in the locking pliers according to the present disclosure, the lever pad may be supported and rotated on the bottom of a fixed structure to draw an object according to the lever principle, thereby applying tension to the object. It is significantly effective in an operation of fixing canvas or the like to a signboard frame by tensioning the canvas.

DETAILED DESCRIPTION

Figure 1:
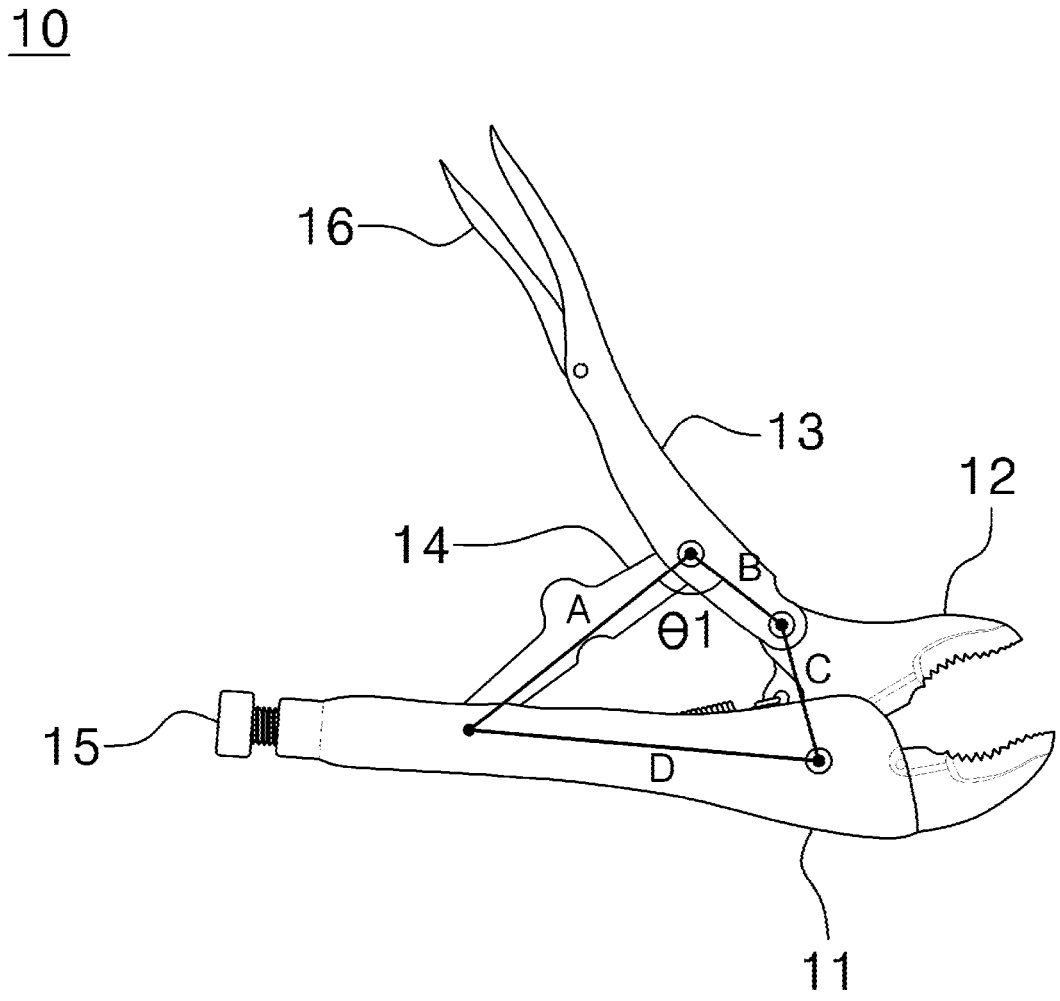
FIG. 1 is a view illustrating the unfastened position of typical locking pliers.

Terms used herein are selected to be as general terms as possible that are widely used at present but some terms are designated by the applicant for specific cases. The terms designated by the applicant should be interpreted in consideration of the meanings of the terms described or used in the detailed description, not by the names of the terms.

Hereinafter, the technical configuration of the present disclosure will be described in detail with reference to exemplary embodiments illustrated in the accompanying drawings.

However, the present disclosure is not limited to embodiments described hereinafter and may be implemented in other forms. Throughout the specification, the same reference numerals are used to indicate the same components.

Figure 3:
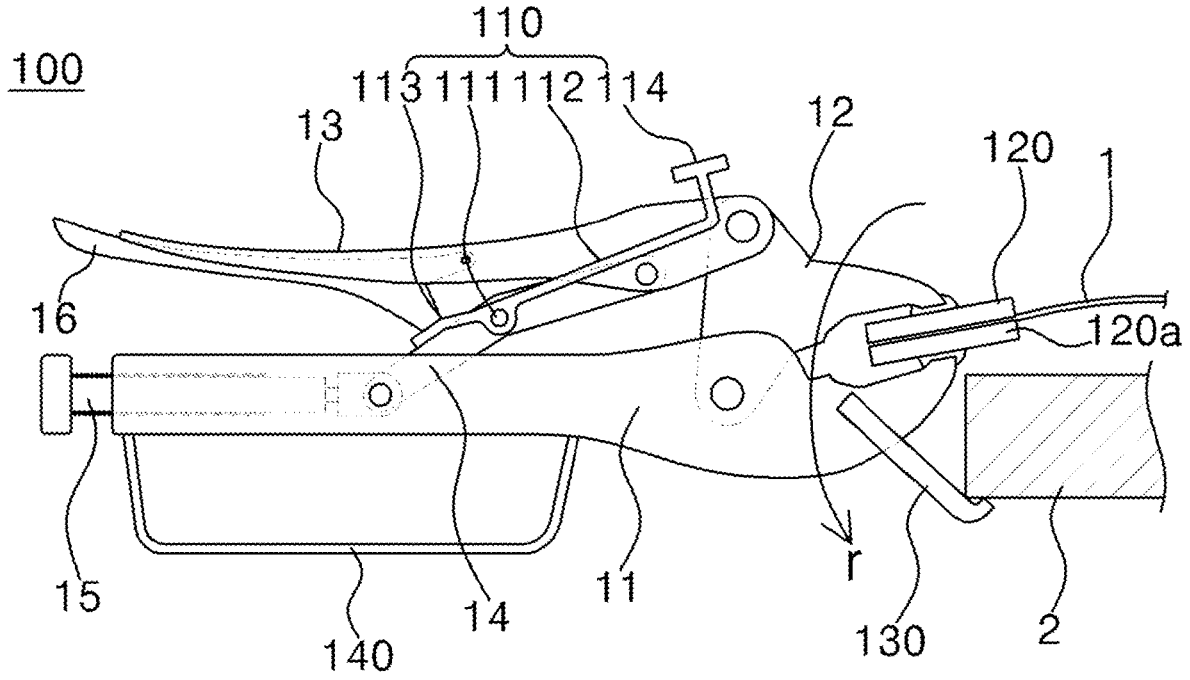
FIG. 3 is a view illustrating the fastening position of locking pliers according to an embodiment of the present disclosure.
Figure 4:
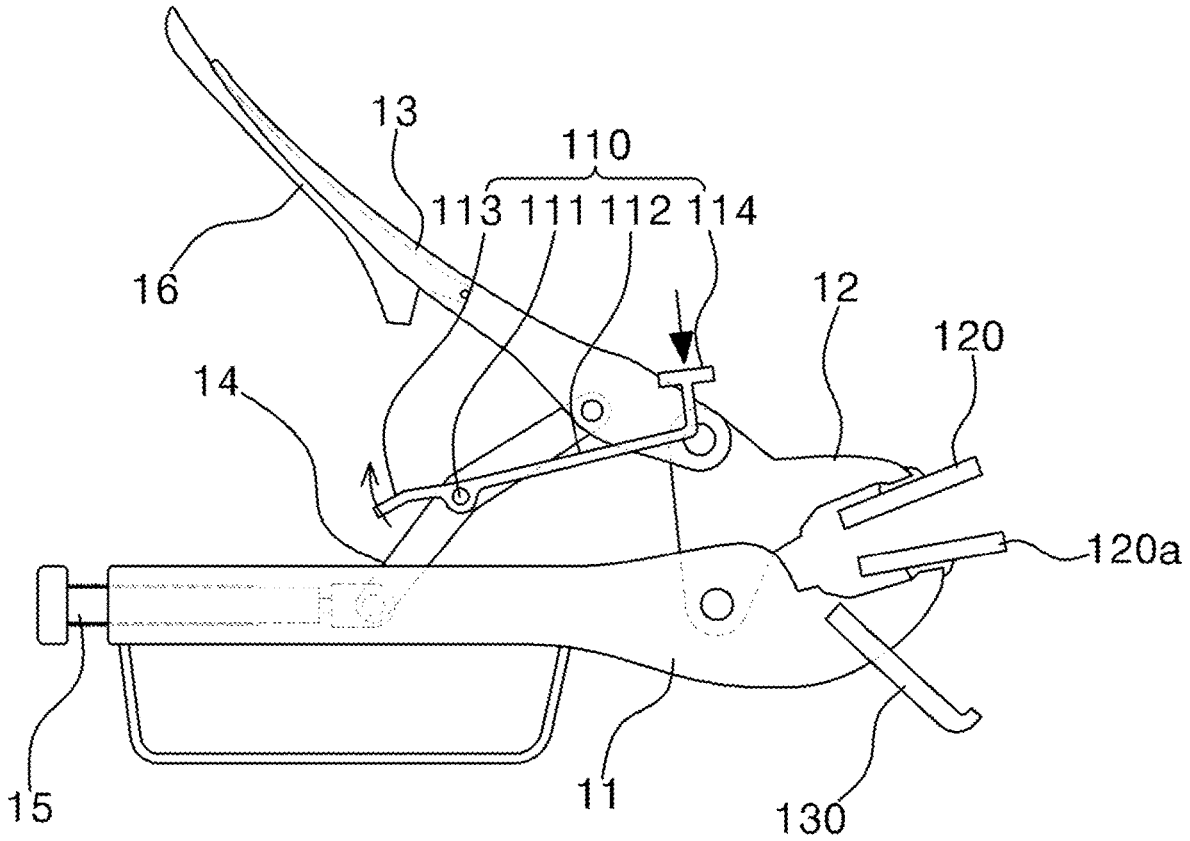
FIG. 4 is a view illustrating the unfastened position of the locking pliers according to the embodiment of the present disclosure.

FIG. 3 is a view illustrating the fastening position of locking pliers according to an embodiment of the present disclosure, and FIG. 4 is a view illustrating the unfastened position of the locking pliers according to the embodiment of the present disclosure.

Referring to the figures, locking pliers 100 according to an embodiment of the present disclosure are a tool configured to hold or release an object 1 using a toggle mechanism having a four-link structure. In particular, the locking pliers 100 are especially useful for a signboard assembly operation of tensioning a sheet of canvas by drawing the canvas to a signboard frame and then repeating stapling.

The locking pliers 100 include a fixed lever 11, a pivot jaw 12, a movable lever 13, an adjustment bar 14, an adjustment bolt 15, an unlocking lever 16, and an opening lever 110. The locking pliers 100 may further include engagement pads 120 and 120*a*, a lever pad 130, and a handle fence 140.

Figure 2:
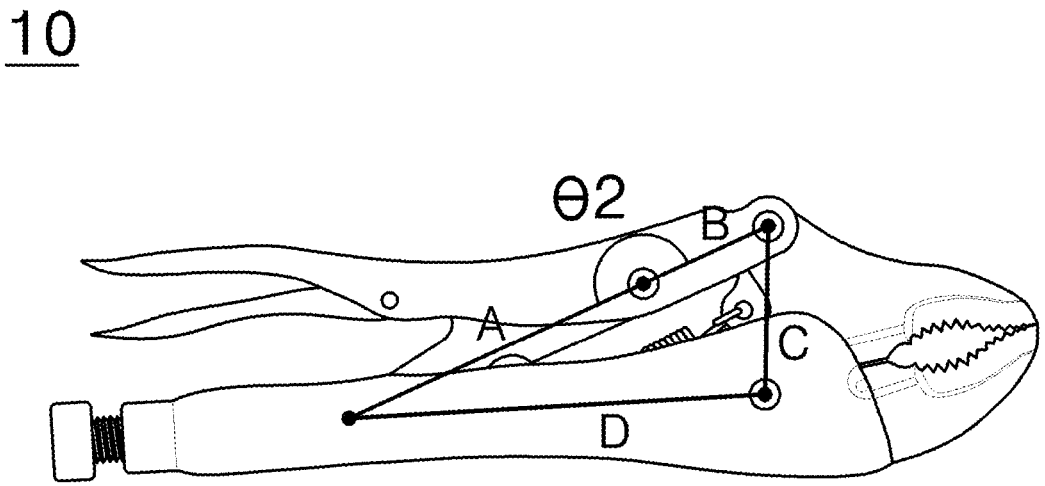
FIG. 2 is a view illustrating the fastened position of typical locking pliers.

In addition, the fixed lever 11, the pivot jaw 12, the movable lever 13, the adjustment bar 14, the adjustment bolt. 15, and the unlocking lever 16 are substantially the same as the fixed lever 11, the pivot jaw 12, the movable lever 13, the adjustment bar 14, the adjustment bolt 15, and the unlocking lever 16 of the typical locking pliers 10 illustrated in FIGS. 1 and 2, and detailed descriptions thereof will be omitted.

The opening lever 110 having the shape of a bar may be hinged to a side surface of the adjustment bar 14 so as to be pivotable. The opening lever 110 includes a front portion 112 and a rear portion 113 on both sides of a hinge shaft 111, with the front port on 112 facing the pivot jaw 12.

In addition, the opening lever 110 may be hinged to any side, i.e., the left side or the right side, of the adjustment bar 14 according to the physical characteristics of a user and the purpose of an operation.

In addition, the front portion 112 is longer than the rear portion 113. A pressing portion 114 is provided on a distal end of the front portion 112 and has a predetermined area allowing the user holding the fixed lever 11 and the movable lever 13 to press the pressing portion 114 with the thumb.

In addition, a distal end of the rear portion 113 is in contact with one end of the unlocking lever 16. When the pressing portion 114 is pressed, the distal end of the rear portion 113 pushes one end of the unlocking lever 16 to move the movable lever 13 away from the adjustment bar 14 so that the distance between the movable lever 13 and the adjustment bar 14 is widened, thereby releasing the locking.

In addition, the front portion 112 is longer than the rear portion 113 such that the unlocking lever 16 may be pushed upward with a relatively small amount of force.

In the locking pliers 100, although the unlocking lever 16 is not separately provided, the rear portion 113 of the opening lever 110 may be directly in contact with the movable lever 13 to move the movable lever 13 away from the fixed lever 11 to release the fastening. Thus, the unlocking lever 16 may be selectively provided.

Thus, there is an advantage in that the locking and the unlocking of the locking pliers may be performed rapidly in an operation by pressing the pressing portion 114 with the thumb of one hand holding the locking pliers, differently from the typical locking pliers 10 in which the movable lever 13 and the fixed lever 11 must be held with one hand while the unlocking lever 16 are being pressed with the other hand in order to release the locking.

The engagement pads 120 and 120*a* respectively having a predetermined area are provided on distal ends of the pivot jaw 12 and the fixed lever 11 configured to directly hold d the object 1, and serve to help the object 1 be reliably held.

Since the engagement pads 120 and 120*a* respectively have the predetermined area, it is significantly effective when the object 1 is a thin and flexible object, such as a film or cloth.

Furthermore, the lever pad 130 is provided on the fixed lever 11 while being spaced apart from the bottom end of the engagement pad 120*a* of the fixed lever 11 by a predetermined distance. The lever pad 130 may be supported on the bottom of a fixed structure 2 and be rotated in a direction. 'r' to draw the object 1 according to the lever principle, thereby applying tension to the object 1.

The lever pad 130 is very effective when the object 1 applies tension to the canvas or the like used in the construction of a signboard.

The handle fence 140 is a rim-shaped structure provided on the bottom of the fixed lever 11, and has a size to accommodate four fingers except for the thumb when the locking pliers are used. The handle fence 140 serves to prevent the locking pliers 100 from being released from the hand during an operation.

Although the exemplary embodiment of the present disclosure has been described for illustrative purposes, those skilled in the art will appreciate that the foregoing embodiment is not limitative and various modifications and alterations are possible without departing from the scope and spirit of the present disclosure.

The locking pliers, a type of tool, according to the present disclosure has industrial applicability.

What is claimed is:

1. Locking pliers comprising:

a fixed lever;

a pivot jaw hinged to the fixed lever such that a distal end of the pivot jaw pivots toward a distal end of the fixed lever to hold an object;

a movable lever hinged to the pivot jaw to pivot the pivot jaw when pressed;

an adjustment bar having one end thereof being hinged to the movable lever and the other end thereof being hinged to an adjustment bolt provided on the fixed lever, wherein, when the movable lever is pressed, the adjustment bar fixes the movable lever in a pressed position;

a bar-shaped opening lever hinged to the adjustment bar instead of the movable lever so as to be pivotable, the opening lever comprising a front portion and a rear portion on both sides of a hinge shaft, the front portion facing the pivot jaw, wherein the rear portion of the opening lever is in contact with one end of the unlocking lever when in the locked position and moves one end of the unlocking lever away from the adjustment bar to release the locked position when the pressing portion is pressed; and an unlocking lever provided on and hinged to the movable lever, the unlocking lever being configured such that one end thereof is in contact with the adjustment bar when in the locked position and presses the adjustment bar when the other end thereof is pressed so that the movable lever is moved away from the adjustment bar to release the locked position, wherein a bottom of the fixed lever is to be covered with four fingers except for the thumb, and the thumb is to be placed on top of the movable lever when the locking pliers are in a position in which the fixed lever is located below while the movable lever is located above; and a pressing portion is provided on the front portion, the pressing portion being configured to be pressed with the thumb of a hand holding the fixed lever and the movable lever, and the rear portion is in contact with the movable lever when a locked position is accomplished when the movable lever is pressed and pushes the movable lever upward from a side of the fixing lever to release the locked position when the pressing portion is pressed in a direction from the movable lever to the fixed lever.

2. The locking pliers according to claim 1, wherein engagement pads are provided on a distal end of the fixed lever and a distal end of the pivot jaw, the engagement pads having predetermined areas and being configured to hold an object; and the engagement pad comprises a lever pad configured to be supported and rotated on a bottom of a fixed structure to draw the object according to lever principle while the object is being held by the engagement pads.

3. The locking pliers according to claim 1, wherein engagement pads are provided on a distal end of the fixed lever and a distal end of the pivot jaw, the engagement pads having predetermined areas and being configured to hold an object; and the engagement pad comprises a lever pad configured to be supported and rotated on a bottom of a fixed structure to draw the object according to lever principle while the object is being held by the engagement pads.

* * * * *